US005265514A

United States Patent [19]

Schertz

[11] Patent Number: 5,265,514

[45] Date of Patent: Nov. 30, 1993

[54] RATTLE DRUMSTICK

[76] Inventor: Joseph M. Schertz, P.O. Box 10798, White Bear Lake, Minn. 55110

[21] Appl. No.: 967,791

[22] Filed: Oct. 28, 1992

[51] Int. Cl.[5] ..... G10D 13/02

[52] U.S. Cl. ..... 84/422.4; 446/419; D17/22

[58] Field of Search ..... 84/422.4; 446/419; D17/22; D21/64; 231/3

[56] References Cited

U.S. PATENT DOCUMENTS

| | | | |
|---|---|---|---|
| 2,318,460 | 5/1943 | Brief | 84/422 |
| 2,466,554 | 4/1949 | Mossey | 84/422 |
| 2,485,824 | 10/1949 | Gladstone | 84/422 |
| 2,521,336 | 9/1950 | Bramson | 84/422 |
| 3,566,737 | 3/1971 | Gussak | 84/402 |
| 3,592,097 | 7/1971 | Friede | 84/402 |
| 4,165,671 | 8/1979 | DeBose | 84/402 |
| 4,179,973 | 12/1979 | White | 84/402 |
| 4,202,241 | 5/1980 | Lucas | 84/422 S |
| 4,901,617 | 2/1990 | Malone et al. | 84/402 |
| 5,031,827 | 7/1991 | van Braunhut | 231/3 |
| 5,044,250 | 9/1991 | Beyer | 84/422.4 |
| 5,179,237 | 1/1993 | Grossman | 84/422.4 |

*Primary Examiner*—Michael L. Gellner
*Assistant Examiner*—Patrick J. Stanzione
*Attorney, Agent, or Firm*—James W. Miller

[57] ABSTRACT

An improved drumstick is provided for producing a rattling maraca type sound as the drumstick is used by the drummer. The drumstick includes a tip section for striking the drum, a handle section which is used to grip the drumstick, and an intermediate connecting section that joins the tip and handle sections together and forms a complete drumstick. The intermediate connecting section includes a hollow cavity in which a number of pellete are loosely received. When the drummer uses the drumstick to strike a drum or cymbal, the pellets can move around within the cavity to produce a rattle sound. The cavity is contained only within the intermediate connecting section, and does not underlie the handle section, so that the drummer's hand will not dampen or muffle the rattle sound as it grips the drumstick.

19 Claims, 1 Drawing Sheet

RATTLE DRUMSTICK

TECHNICAL FIELD

This invention relates to a drumstick for striking a drum, cymbal or the like. More particularly, this invention relates to a drumstick which produces a "rattle" type sound, similar to that produced by a maraca, when the drumstick is used.

BACKGROUND OF THE INVENTION

Drums are well known musical instruments comprising a drumhead that is tightly stretched over one or both ends of a drum body. The drummer strikes or beats the end of a drumstick against the drumhead to produce the well known percussion sound of a drum. In a typical set of drums, there are two major types of drums, i.e. a snare drum and a bass drum, which are similar but vary in size. A drummer typically uses a handheld drumstick to play the snare drum and uses a foot pedal to impact a separate drumstick against the bass drum. Often, a drum set will also include a set of cymbals that are played using the same hand held drumsticks used to play the snare drum.

The handheld drumsticks conventionally used by drummers are also well known. They typically comprise a solid wooden body having an elongated shape. The drumstick includes a tapered tip section having an enlarged tip member which impacts against the drumhead. The drumstick body extends away from the tip section to terminate in a second end that is spaced away from the tip section by some distance, e.g. 16 inches or so. The drummer can hold and move the drumstick by gripping the drumstick body adjacent the second end thereof.

Maracas are also well known musical instruments that are sometimes played by drummers. These instruments typically comprise a hollow gourd or ball having a number of pellets or beads contained therein and including an outwardly extending handle. The drummer can grip the maraca handle and shake the maraca gourd to produce a distinctive rattle sound. In most cases, separate maracas are provided so that the drummer has to lay down one or both of his drumsticks to pick up and play the maracas. In addition to requiring the drummer to purchase and have on hand a set of maracas, the act of playing the maracas while drumming is difficult to do.

Various suggestions have been made to add the rattle type sound of a maraca to a drumstick. For example, U.S. Pat. No. 2,466,554 to Mossey discloses a generally conventional wooden drumstick that is inserted through a maraca gourd so that the maraca gourd is, in effect, a part of the drumstick. U.S. Pat. No. 5,044,250 to Beyer discloses a drumstick made of a hollow, plastic cylindrical tube in which a plurality of loose pellets are contained. A tip is to be releasably joined to one end of the tube. The tube itself forms the handle portion of the drumstick to allow the user to grip and hold the drumstick. The loose pellets inside the drumstick are free to move around and produce the distinctive maraca type rattle sound.

Both of the devices noted above attempt to provide a drumstick in which some means for producing a maraca type rattle sound is contained on or in the drumstick itself. Thus, the drummer can produce the rattle sound while simultaneously using the drumstick to play the drums. It is not necessary to have a separate maraca type instrument, or to put down the drumstick to pick up and play the maraca.

However, both of the drumsticks noted above have various disadvantages. Neither one of them provides a drumstick that is similar in shape, weight or feel to the drumsticks conventionally used by a drummer. For example, the patent to Mossey is basically a drumstick which is stuck through a maraca gourd. Thus, the Mossey drumstick has a non-uniform appearance with a big bulge in the middle formed by the gourd. In addition, the Mossey drumstick is much heavier than a conventional drumstick since all the weight of the maraca gourd and the pellets are added to the normal weight of the drumstick.

The drumstick shown in the Beyer patent comprises a plastic tube in which the pellets are free to move through the length of the tube with a separate drum tip screwed onto one end of the tube. Again, this construction does not look like a conventional drumstick, does not feel like a conventional drumstick, and does not have the same weight as a conventional drumstick. In addition, because the user grips the drumstick simply by gripping and holding the plastic tube, the rattle sound produced by the drumstick will be somewhat dampened or muffled by the user's hand. This obviously detracts from the rattle sound that is supposed to be produced by the pellets in the first place.

SUMMARY OF THIS INVENTION

One aspect of this invention is to provide a drumstick that can provide a rattle type sound similar to that produced by a maraca and/or shaker, wherein the drumstick is substantially similar in feel, appearance, and/or weight to the conventional drumsticks often used by drummers. In addition, it is an aspect of this invention to provide such a drumstick which is durable and inexpensive to manufacture.

These and other aspects of the present invention are provided by a drumstick for use in striking a drum or cymbal. The drumstick comprises an elongated drumstick body which extends between opposite ends thereof. The drumstick body includes three sections which comprise a tip section, a handle section and an intermediate connecting section. The tip-section has a tip member suited for striking the drum or cymbal, the tip section being located adjacent one end of the drumstick body with the tip member forming said one end of the drumstick body. The handle section is located adjacent the other end of the drumstick body. The handle section is sufficiently large to allow a user to grip and hold the drumstick by gripping and holding the handle section with at least one hand. Finally, the intermediate connecting section extends between and joins the tip and handle sections of the drumstick body together. The intermediate connecting section includes a hollow cavity in which a plurality of pellets are loosely received such that the pellets are free to move around within the cavity as the drumstick body is moved by the user to produce a rattle sound. The pellet receiving cavity is contained within the intermediate connecting section such that the cavity does not underlie the handle section of the drumstick body so that the user's hand on the handle section does not dampen or muffle the rattle sound produced in the intermediate connecting section by the movement of the loose pellets within the cavity.

BRIEF DESCRIPTION OF THE DRAWINGS

This invention will be described more completely in the following Detailed Description, when taken in conjunction with the following drawings, in which like referenced numerals refer to like elements throughout.

DETAILED DESCRIPTION

Figure 1:
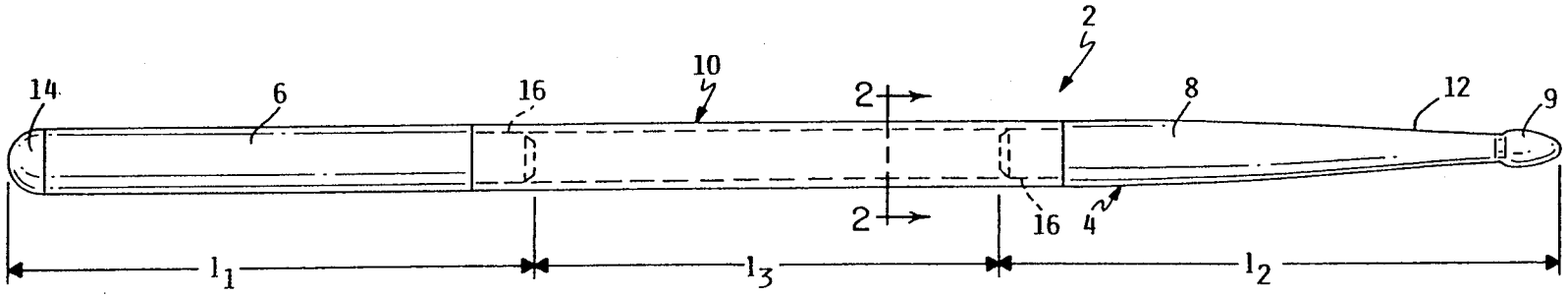
FIG. 1 is a top plan view of an improved drumstick according to the present invention, particularly illustrating a drumstick with a hollow, intermediate connecting section containing a plurality of loose pellets for producing a rattle type sound.
Figure 2:
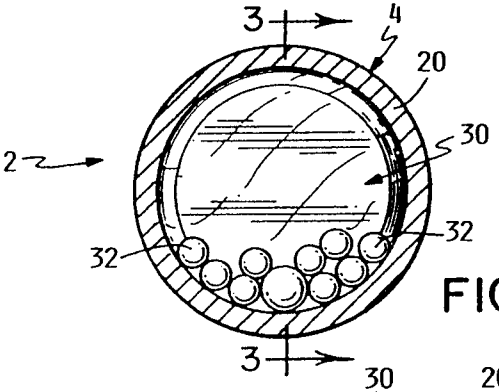
FIG. 2 is a cross-sectional view of the improved drumstick of this invention, taken along lines 2—2 in Fig. 1.

Referring first to FIG. 1, an improved drumstick according to the present invention is generally illustrated as 2. Drumstick 2 as shown herein is meant to closely resemble a conventional drumstick of the type used by a drummer to play a snare type drum. As is true of such conventional drumsticks, drumstick 2 can be provided in different lengths, can be made of different materials, and may have different weights depending on the type of materials used to make drumstick 2. However, the present invention is not limited for use with a snare drum type drumstick, but may be used with any drumstick.

Figure 3:
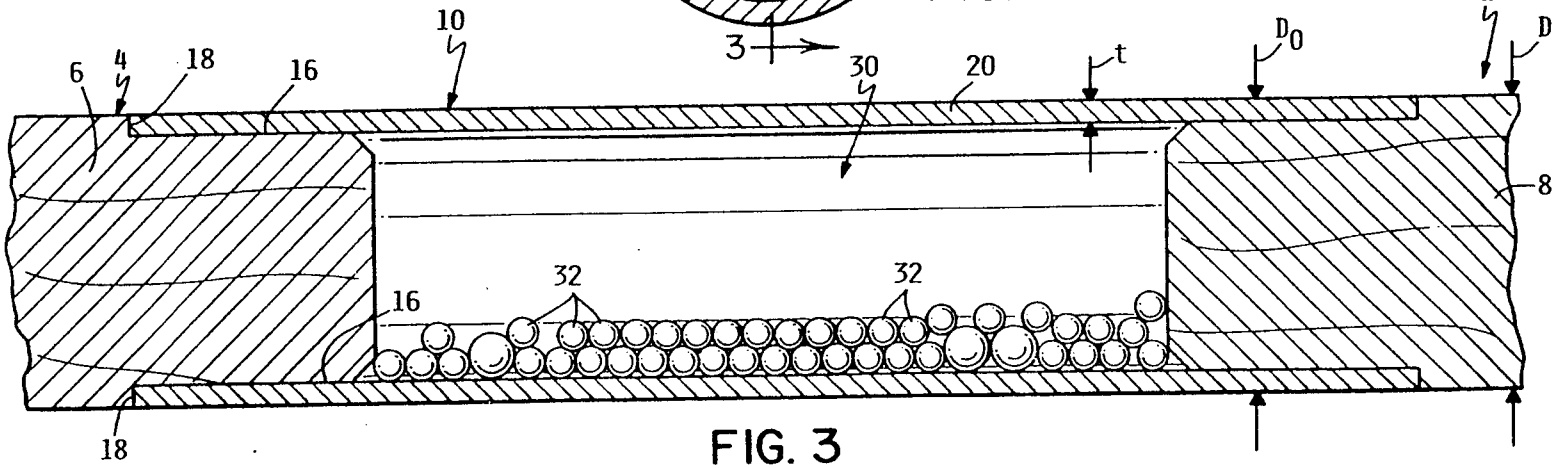
FIG. 3 is a partial cross-sectional view of a portion of the drumstick shown in FIG. 1, taken along lines 3—3 in FIG. 2, particularly illustrating a plurality of loose pellets or beads contained in the intermediate connecting section thereof.

Drumstick 2 comprises an elongated drumstick body 4 that has, over most of its length, a generally constant or uniform diameter, indicated as D in FIG. 3, such that body 4 has a slender, generally cylindrical form. Drumstick body 4 has three sections, namely a handle section 6 adjacent one end of body 4 which the user can grip to hold and move drumstick 2, a tip section 8 located adjacent the other end of drumstick 2 which includes an enlarged tip member 9 that can be used to impact or strike the drumhead, cymbal or the like, and an intermediate connecting section 10 that extends between and integrally joins handle and tip sections 6 and 8 together as will be described in more detail hereafter. The outer end of tip section 8 is slightly tapered inwardly from the nominal diameter D of body as shown at 12 in FIG. 1, and the outer end of handle section 6 is rounded as shown at 14 in FIG. 1, such that drumstick body 4 is not purely cylindrical over its entire length, though it remains largely cylindrical. Drumstick 2 is meant to resemble in shape the conventional wooden drumsticks traditionally used by drummers.

Handle and tip sections 6 and 8 are desirably made from a solid material and preferably, though not necessarily, from wood. Intermediate connecting section 10 is made from a hollow tube 20, made from metal, having an outer diameter $D_o$ which is substantially the same as the nominal diameter D of drumstick body 4. Thus, when intermediate connecting section 10 is in place joining handle and tip sections 6 and 8 together, the generally uniform, cylindrical appearance of drumstick 2 is preserved. Drumstick 2 has a shape and length generally identical to the conventional wooden drumstick that it replaces and there are no strange or unsightly bulges in drumstick 2. Again, the diameter and length of drumstick 2 can vary from one model of drumstick 2 to the next, but it is intended that a drumstick 2 according to this invention will have the same shape and length as a conventional, wooden drumstick.

The ends of handle and tip sections 6 and 8 of drumstick body 4 are press fit into opposed ends of hollow tube 20 in order to join them together. In this regard, keeping in mind the desirability of having tube 20 form a smooth continuation of the diameter D of drumstick body 4, the ends of handle and tip sections 6 and 8 are cut away forming an annular shoulder 18 and recess 16 having a depth equal to the thickness t of the wall of tube 20. Thus, when the ends of handle and tip sections 6 and 8 are telescopically inserted into the open ends of tube 20, tube 20 does not protrude substantially beyond the diameter of drumstick body 4 but conforms generally to diameter D as shown in FIG. 3.

While the use of recesses 16 is preferred, it would be possible for the recesses 16 to be dispensed with and the ends of handle and tip sections 6 and 8 simply telescopically press fit into the open ends of tube 20. In this case, tube 20 would slightly protrude out past the diameter D of drumstick body 4 by the thickness t of the wall of tube 20, but this thickness is relatively small, e.g. one eighth of an inch or so. Thus, drumstick body 4 would still have a generally uniform diameter and cylindrical appearance and such a drumstick would still fall within the present invention.

In manufacturing a drumstick 2 according to the present invention, a conventional wooden drumstick can be used and cut apart into three sections comprising a handle section of the length $l_1$ as shown in FIG. 1, a tip section of the length $l_2$ as shown in FIG. 1, and an intermediate section of the drumstick of the length $l_3$ as shown in FIG. 1 which intermediate section length $l_3$ simply comprises the remaining length of the drumstick. The handle and tip sections of the cut apart drumstick are retained while the intermediate section is discarded. The ends f handle and tip sections 6 and 8 are then provided with the annular cut away recesses 16 in any suitable fashion, e.g. by using a lathe or any other appropriate tool for slightly reducing the diameter of the ends of these sections. The recesses 16 of sections 6 and 8 can then be press fit into a hollow metallic tube 20 which has been cut to the proper length, e.g. a length so that drumstick 2 when completed will have the same length, or approximately the same length, as the original wooden drumstick.

In accomplishing the press fit between handle and tip sections 6 and 8 and tube 20, it is desirable that handle and tip sections 6 and 8 be rigidly secured to tube 20. Accordingly, the diameter of recesses 16 of these sections is desirably somewhat larger, e.g. a few thousandths of an inch, than the inner diameter of tube 20. Cryogenic techniques can be used to help insert recesses 16 of handle and tip sections 6 and 8 into tube 20. For example, the ends of handle and tip sections 6 and 8 can be cooled to shrink them from their normal diameter. Alternatively, or in addition to this shrinkage of recesses 16, tube 20 can be heated to expand its inner diameter. Either or both of these steps allows recesses 16 of handle and tip sections 6 and 8 to be more easily inserted into tube 20. When the materials regain ambient temperatures, the recesses 16 of handle and tip sections 6 and 8 will tend to expand back to their normal diameter, and/or tube 20 will tend to shrink back to its normal diameter, forming a tight and permanent connection between the components. Applicant has found that this connection is sufficiently strong so that handle and tip sections 6 and 8 are non-removable from intermediate connecting section 10 during normal use of drumstick 2.

When a drumstick 2 is made according to this method, intermediate connecting section 10 includes or forms a hollow cavity 30 comprising the interior space of tube 20 extending between the handle and tip sections 6 and 8 which are telescopically received inside tube 20. A plurality of loose beads, balls or pellets 32 are inserted into cavity 30 before the assembly of tube 20 to handle and tip sections 6 and 8 is finished. The number of these pellets 32 is chosen to allow pellets 32 to move within cavity 30 both axially and radially as drumstick 2 is moved, i.e. pellets 32 fill up substantially less than the volume of cavity 30. However, enough pellets are placed into cavity 30 so that a distinctive rattling sound will be produced as drumstick 2 is used. Thus, as the drummer uses drumstick 2 to play the drums or hit a cymbal, drumstick 2 will simultaneously provide a rattle type sound similar to that produced by a maraca and/or shaker. Thus, a separate maraca and/or shaker need not be provided or played by the drummer.

Preferably, handle and tip sections 6 and 8 are made from the types of wood that are often used to make drumsticks, e.g. a relatively hard wood, and tube 20 is made from a durable metallic material, e.g. aluminum or the like. The use of a metal to make tube 20 is preferred because such intermediate connecting section 10 will sometimes be impacted against the rim of the drum. Intermediate connecting section 10 must have enough strength to withstand such impact. While the use of these materials is preferred, obviously other suitable materials can be substituted therefor.

Handle section 6 of drumstick 2 is long enough to allow at least one of the drummer's hand to easily grip and hold drumstick body 4 without overlapping in any significant way hollow tube 20. This is preferred since the sound produced by intermediate connecting section 10 will not be dampened or muffled in any way by the drummer's hand. Thus, the rattle type sound produced by intermediate connecting section 10 will have its full effect at all times. In a drumstick 2 having an overall length of 16 inches, a handle section 6 having an exposed length of 5 inches, a tube 20 having a length of 6 inches, and a tip section 8 having an exposed length of 5 inches has been found to provide a handle section 6 that is sufficiently long for the purposes of the present invention.

It is apparent that drumstick 2 of this invention has the shape and general feel to a drummer of a conventional snare type drumstick. The handle and tip sections can be made from the same types of materials that the drummer is accustomed to using, which is most often wood. Thus, drumstick 2 will feel the same to the drummer. In addition, drumstick 2 conforms in shape and length to the drumstick that it replaces. Both of these similarities will increase the drummer's comfort level with drumstick 2, and ultimately, his acceptance and use of it.

In addition, the weight of drumstick 2 can be easily adjusted to be approximately the same as the weight of a solid, wooden unmodified drumstick. In this regard, the combined weight of hollow tube 20 and all the loose pellets 32 added to tube 20 is desirably approximately the same as the weight of that intermediate connecting section of drumstick 2 of length $l_3$ which is removed and discarded when the conventional drumstick is cut apart to form the handle and tip sections 6 and 8 thereof. Again, while this weight matching is not strictly necessary to the present invention, it is preferred and helps to further provide a drumstick 2 that closely resembles the drumstick the drummer is accustomed to using.

Drumstick 2 of this invention is durable and inexpensive to manufacture. A minimum of additional components is required. No specially formed plastic tubes or the like are needed to form drumstick body 4. No special attachments, such as a screw thread connection, are required for connecting handle or tip sections 6 and 8 to drumstick body 4. A conventional wooden drumstick can be cut apart to form the handle and tip sections 6 and 8 and these are simply press fit into a hollow, cylindrical tube 20 in a rigid and permanent manner. Accordingly, drumstick 2 of this invention will be extremely reliable and durable, but relatively inexpensive to manufacture.

Various modifications of this invention will be apparent to those skilled in the art. Accordingly, this invention is to be limited only by the appended claims.

I claim:

1. A drumstick for use in striking a drum or cymbal, the drumstick suited for being held by at least one hand of a drummer with the drummer's hand including a palm and a plurality of fingers extending outwardly from the palm, which comprises:

an elongated drumstick body which extends between opposite ends thereof, wherein the drumstick body includes three sections which comprise:

(a) a tip section having a tip member suited for striking the drum or cymbal, the tip section located adjacent one end of the drumstick body with the tip member forming said one end of the drumstick body;

(b) a handle section located adjacent the other end of the drumstick body, wherein the handle section is sufficiently long to allow the drummer to grip and hold the drumstick by gripping and holding the handle section with at least one hand, and wherein the handle section is sufficiently long such that substantially the entire palm of the drummer's hand is capable of lying substantially flat against the handle section to overlie the handle section with the fingers of the hand being capable of encircling the handle section to grip and hold the handle section; and (c) an intermediate connecting section which extends between and joins the tip and handle sections of the drumstick body together, wherein the intermediate connecting section includes a hollow cavity in which a plurality of pellets are loosely received such that the pellets are free to move around within the cavity as the drumstick body is moved by the drummer to produce a rattle sound, and wherein the pellet receiving cavity is contained within the intermediate connecting section such that the cavity does not underlie the handle section of the drumstick body so that the drummer's hand on the handle section does not dampen or muffle the rattle sound produced in the intermediate connecting section by the movement of the loose pellets within the cavity.

2. A drumstick as recited in claim 1, wherein the intermediate connecting section has approximately the same diameter as those portions of the tip section and the handle section to which the intermediate connecting section is joined.

3. A drumstick as recited in claim 2, wherein the drumstick body has a generally uniform outer diameter over the handle section, the intermediate connecting section and at least a portion of the tip section.

4. A drumstick as recited in claim 3, wherein an outer portion of the tip section immediately adjacent the tip member is slightly tapered inwardly relative to the generally uniform diameter of the drumstick body.

5. A drumstick as recited in claim 1, wherein the tip section and the handle sections of the drumstick body are made from wood.

6. A drumstick as recited in claim 5, wherein the intermediate connecting section is made from a metallic material to minimize denting or breakage of the intermediate connecting section when the intermediate connecting section impacts against a rim of the drum.

7. A drumstick as recited in claim 1, wherein the tip section and the handle sections of the drumstick body are substantially solid throughout the length thereof, and wherein the intermediate connecting section comprises a hollow connecting tube having open ends.

8. A drumstick as recited in claim 7, wherein the tip section is joined to one end of the hollow connecting tube and the handle section is joined to the other end of the hollow connecting tube.

9. A drumstick as recited in claim 8, wherein the tip section and the handle section have a press fit in the open ends of the connecting tube.

10. A drumstick as recited in claim 9, wherein the tip section and the handle section have a normal diameter that is slightly larger than an inner diameter of the connecting tube such that the tip and handle sections are non-removably fixed to the tube when they are press fit together.

11. A drumstick as recited in claim 9, wherein the tip section and the handle section are each provided on end thereof with a recess extending there around to form a connecting peg protruding along a longitudinal axis, and wherein the connecting pegs on the tip and handle sections are each press fit telescopically into one of the open ends of the connecting tube.

12. A drumstick as recited in claim 11, wherein the recess has a depth approximately equal to the thickness of a wall of the tube such that the tube when connected over the recesses of the tip and handle section will form a body having a generally uniform diameter.

13. A drumstick as recited in claim 1, wherein the tip and handle sections are each made from the same material, and wherein the weight of the drumstick body including the weight of the pellets contained within the intermediate connecting section is approximately the same as the weight of a solid drumstick of the same shape manufactured from the same material used to form the tip and handle sections of the drumstick.

14. A drumstick for use in playing a drum or the like, the drumstick suited for being held by at least one hand of a drummer with the drummer's hand including a palm and a plurality of fingers extending outwardly from the palm, which comprises:

an elongated body which extends between opposed ends, the drumstick body being generally cylindrical over its length except for a tip section located adjacent one end of the drumstick body, the tip section being slightly tapered inwardly relative to the cylindrical form of the drumstick body and terminating in a tip member that forms said one end of the drumstick body which tip member is suited for striking a drum or cymbal, the drumstick body having a central, hollow cavity adjacent the tip section in which a plurality of pellets are loosely received such that the pellets are free to move around in the cavity to produce a rattle sound as the drummer moves the drumstick, the pellets being confined inside the cavity such that the movement of the pellets is confined to a central portion of the drumstick body, and wherein the drumstick body includes a handle section adjacent the cavity on the opposite end of the cavity from the tip section, wherein the handle section is sufficiently long such that a drummer can grip and hold the drumstick body at the handle section with one hand without having the drumer's hand appreciably overlie the hollow cavity such that the rattle sound being produced by the pellets within the cavity is not dampened by the act of gripping and holding the drumstick body, and wherein the handle section is sufficiently long such that substantially the entire palm of the drummer's hand is capable of lying substantially flat against the handle section to overlie the handle section with the fingers of the hand being capable of encircling the handle section to grip and hold the handle section.

15. A drumstick as recited in claim 14, wherein the tip and handle sections of the drumstick body comprise solid members, and wherein the hollow cavity of the drumstick body is formed by a hollow tube that is rigidly joined at either end to the tip and handle sections.

16. A drumstick s recited in claim 15, wherein the tip and handle sections are made of wood.

17. A drumstick as recited in claim 16, wherein the tube is made of a metallic material.

18. A drumstick as recited in claim 15, wherein the tip and handle sections are press fit into the ends of the hollow tube.

19. A drumstick for use in striking a drum or cymbal, which comprises:

an elongated drumstick body which extends between opposite ends thereof, wherein the drumstick body includes three sections which comprise:

(a) a tip section having a tip member suited for striking the drum or cymbal, the tip section located adjacent one end of the drumstick body with the tip member forming said one end of the drumstick body;

(b) a handle section located adjacent the other end of the drumstick body, wherein the handle section is sufficiently large to allow a user to grip and hold the drumstick by gripping and holding the handle section with at least one hand;

(c) an intermediate connecting section which extends between and joins the tip and handle sections of the drumstick body together, wherein the intermediate connecting section comprises a hollow connecting tube having open ends and formed from a tubular wall having a predetermined thickness, and wherein the tip section and the handle section have a press fit in the open ends of the connecting tube; and (d) wherein the tip section and the handle section are each provided on end thereof with a recess extending there around to form a connecting peg protruding along a longitudinal axis, and wherein the connecting pegs on the tip and handle sections are each press fit telescopically into one of the open ends of the connecting tube, and wherein each recess has a depth approximately equal to the tubular wall thickness of the connecting tube such that the tube when connected over the recesses of the tip and handle section will form a body having a generally uniform diameter.

* * * * *